US007578245B2

(12) United States Patent
Loines

(10) Patent No.: US 7,578,245 B2
(45) Date of Patent: Aug. 25, 2009

(54) FURNITURE SUPPORT SYSTEM

(75) Inventor: Barry Loines, Old Farm Park (GB)

(73) Assignee: Ethos (UK) Limited (GB)

( * ) Notice: Subject to any disclaimer, the term of this patent is extended or adjusted under 35 U.S.C. 154(b) by 256 days.

(21) Appl. No.: 10/509,862

(22) PCT Filed: Apr. 2, 2003

(86) PCT No.: PCT/GB03/01435

§ 371 (c)(1),
(2), (4) Date: Jan. 3, 2005

(87) PCT Pub. No.: WO03/082053

PCT Pub. Date: Oct. 9, 2003

(65) Prior Publication Data

US 2005/0166805 A1 Aug. 4, 2005

(30) Foreign Application Priority Data

Apr. 2, 2002 (GB) ..... 0207546.3

(51) Int. Cl.
*A47B 9/00* (2006.01)

(52) U.S. Cl. ..... 108/110; 108/108; 248/245

(58) Field of Classification Search ..... 108/110, 108/106, 144.11, 147.11, 148, 50.01, 60, 108/108, 158.12; 211/193; 248/245, 411, 248/412, 413, 188.7, 158; 312/223.3, 265.5
See application file for complete search history.

(56) References Cited

U.S. PATENT DOCUMENTS 318,343 A * 5/1885 Baublits ..... 248/244
2,937,766 A * 5/1960 Penn ..... 211/193
2,961,212 A 11/1960 Beal
3,114,531 A * 12/1963 Webber ..... 248/242
3,250,584 A 5/1966 Tassell
3,462,110 A 8/1969 Cheslock
3,896,743 A * 7/1975 Pariente ..... 108/190
4,163,537 A * 8/1979 Mourgue ..... 248/188.1
4,192,424 A * 3/1980 Allsop ..... 211/37

(Continued)

FOREIGN PATENT DOCUMENTS

EP 0 815 775 1/1998

(Continued)

OTHER PUBLICATIONS

Search Report under Section 17 conducted by the UK Patent Office and issued to a related foreign application.

(Continued)

*Primary Examiner*—José V Chen
(74) *Attorney, Agent, or Firm*—Knobbe, Martens, Olson & Bear LLP

(57) ABSTRACT

A furniture support system for workstation work tops including a support post (19 having a first locating formation (3) that extends longitudinally along at least a part of the length of the support post (1), and a support element (9, 23) having a second locating formation (15) that is complementary to the first locating formation (3) and engageable therewith, the first and second locating formations (3, 15) being constructed and arranged for sliding movement in the longitudinal direction, such that the position of the support element (9, 23) relative to the support post (1) is adjustable.

19 Claims, 11 Drawing Sheets

U.S. PATENT DOCUMENTS

Figure 1A:
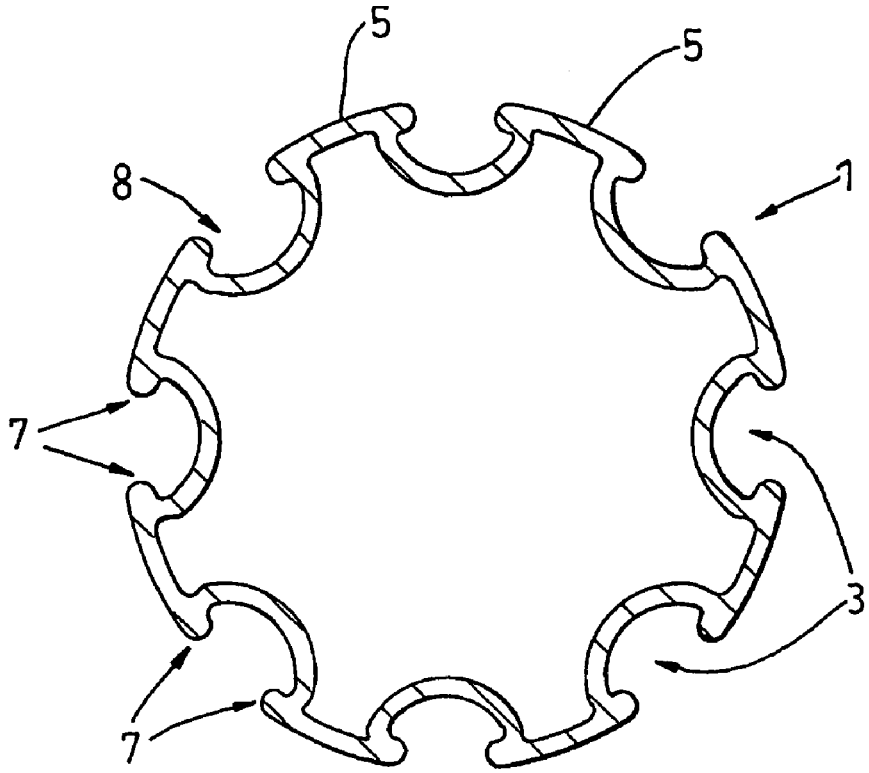

| | | | | |
|---|---|---|---|---|
| 4,528,914 | A * | 7/1985 | Montet | 108/60 |
| 4,895,331 | A * | 1/1990 | Nehls | 108/108 |
| 4,941,763 | A * | 7/1990 | Euteneuer | 403/3 |
| 5,188,323 | A * | 2/1993 | David | 248/158 |
| 5,356,106 | A * | 10/1994 | Trotta et al. | 108/108 |
| 5,484,068 | A * | 1/1996 | Huang | 248/245 |
| 5,531,168 | A * | 7/1996 | Towfigh | 108/108 |
| 5,715,760 | A * | 2/1998 | Frascaroli et al. | 108/50.02 |
| 5,899,423 | A * | 5/1999 | Albertini | 108/50.11 |
| 5,979,119 | A * | 11/1999 | Trafton | 52/40 |
| 6,382,747 | B1 * | 5/2002 | Catta et al. | 108/50.02 |
| 6,484,647 | B2 * | 11/2002 | Lininger Jr. et al. | 108/50.01 |
| 6,776,466 | B2 * | 8/2004 | Harvie, III | 108/108 |
| 7,086,341 | B2 * | 8/2006 | Peddicord | 108/180 |

FOREIGN PATENT DOCUMENTS

| | | |
|---|---|---|
| EP | 0 670 125 | 8/1999 |
| FR | 1.112.706 | 3/1956 |
| GB | 1 494 407 | 12/1977 |
| GB | 2 064 305 A | 6/1981 |
| GB | 2 218 898 | 11/1989 |
| GB | 2 346 548 | 8/2000 |
| WO | WO 02/33272 | 4/2002 |

OTHER PUBLICATIONS

International Search Report completed Jul. 22, 2003 and issued to a related foreign application.

* cited by examiner

FURNITURE SUPPORT SYSTEM

This application is the U.S. National Phase under 35 U.S.C. § 371 of International Application PCT/GB03/01435, filed Apr. 2, 2003, which claims priority of GB 0207546.3, filed Apr. 2, 2002.

The present invention relates to a furniture support system, and in particular, but not exclusively, to a support system for desks and workstations.

Most desks have a work top that is set at a fixed height above the floor, which is designed to be suitable for a person of average stature. However, this height may not be suitable for people who are unusually tall or short. Furthermore, the ideal height of the work top may depend on the tasks being performed at the desk: for example, a desk designed for typing will generally be lower than one designed for writing.

Desks with adjustable height work tops are known, but the adjustment mechanism is often complicated and allows the height to be adjusted only incrementally.

In modern offices desks or workstations are often clustered together, for example two back-to-back, three at 120 degrees or four at 90 degrees. This is usually the case in open plan offices, especially to save space where the rent per unit area is high or where workstations have to share essential facilities such as electricity supply. Electrical sockets are often located at intervals in the floor and several workstations may be positioned around them.

A drawback to clustering workstations is that localised noise is increased making it more difficult for workers to concentrate and the close proximity of other people also makes it difficult to have confidential discussions. A common solution to balancing the need to cluster workstations and providing a degree of privacy is to provide partition screens between desks. Partitions are typically opaque rectangular panels which are available in a variety of sizes. For example, some partitions are quite low and can be seen over from a sitting position whilst others are higher and can only be seen over by standing. The screens can be supported in free standing metal frames, with some systems having a facility for linking panels together.

When clustering workstations together, a typical solution is simply to group a number of individual free-standing workstations together without further integration, i.e there is little or no sharing of components between units. A more economical method is to use an integrated system that allows some components, for example legs, to be shared between adjacent workstations. Such existing systems tend generally to be rather complicated and lacking in versatility.

Accordingly the present invention seeks to provide a furniture support system that mitigates at least one of the aforesaid problems.

According to one aspect of the present invention there is provided a furniture support system including a support post having a first locating formation that extends longitudinally along at least a part of the length of the support post, and a support element having a second locating formation that is complementary to the first locating formation and engageable therewith, the first and second locating formations being constructed and arranged for sliding movement in the longitudinal direction, such that the position of the support element relative to the support post is adjustable.

This invention allows the height of a workstation work top to be adjusted to a height which is comfortable for the person using the workstation when performing a particular activity.

Advantageously the position of the support element relative to the support post is continuously adjustable. Continuous adjustment of the support element relative to the post overcomes the limited number of settings to which discrete systems are restricted.

Preferably the first locating formation comprises a channel formed in the surface of the support post. This is a simple and strong mechanism which can be easily adjusted to suit the needs of the person using the workstation. The channel may include a pair of parallel lips defining a mouth, and a channel body located behind the mouth, the mouth being narrower than the channel body.

Advantageously the first locating formation extends along substantially the entire length of the support post. This feature allows a full range of positional settings of the support element relative to the support post and the support post to be manufactured by an extrusion process.

The support element may include locking means for fixing its position relative to the support post. The locking means can be of any type that applies pressure to the support post. Preferably the locking means is arranged to apply a compressive load on the first locating formation. For example, the second locating formation has an upper end and a lower end, and the locking means is located towards the lower end and is constructed and arranged for compressive engagement with the support post. Advantageously the locking means may include a screw element engageable with the support post.

Preferably the support post is substantially cylindrical and preferably the support element comprises a bracket for supporting a workstation work top.

Advantageously the furniture support system can include a screen support member for supporting a partition screen. Preferably the screen support member includes a third locating formation that is complementary to the first locating formation and engageable therewith, the first and third locating formations being constructed and arranged for sliding movement in the longitudinal direction, such that the position of the screen support member relative to the support post is continuously adjustable.

The support post may include a plurality of angularly spaced first locating formations. This allows the support post to support a plurality of components: for example, work tops and partition screens. Using support elements and screen support members a variety of configurations can be achieved to support, for example, a plurality of work tops, or a combination of work tops and partition screens. Since a number of components can share a single support post this leads to a reduction in the number of parts required and hence a reduction in cost.

Preferably the support post includes between three and sixteen first locating formations, or between eight and twelve first locating formations. However, these ranges are by way of example only and the invention is not to be construed as being strictly limited to embodiments having a number of first locating formations within one of these ranges. The invention includes support posts having any practicable number of first locating formations.

The first locating formations preferably extend substantially parallel to one another. Advantageously the support post includes attachment means for connecting two posts end to end. This can extend the height of a support post arrangement, for example, to provide support for a large partition screen and is preferably arranged to allow continuous adjustment through the joint.

According to another aspect of present invention the furniture support system includes a support post having a first locating formation including a channel that extends longitudinally along at least a part of the length of the support post, and a support element having a second locating formation that is complementary to the first locating formation and engageable therewith, the first and second locating formations being constructed and arranged for sliding movement in the longitudinal direction such that the position of the support element relative to the support post is continuously adjustable, wherein the support element includes locking means for fixing its position relative to the support post, and the locking means is constructed and arranged for compressive engagement with the channel.

The furniture support system can be used in a workstation which includes a work top and a plurality of legs for supporting the work top, wherein at least one of the legs comprises a furniture support system as described above and the position of the work top relative to the support post is adjustable. This allows the user of the workstation to adjust the height of the work top to an appropriate height, having regard for his stature and the type of work to be performed at the workstation.

Likewise, the furniture support system can be used in a set of workstations which includes a plurality of work tops and a plurality of legs for supporting the work tops, wherein at least one of the legs is arranged to support a plurality of the desk tops and comprises a furniture support system as described above. The furniture support system is particularly useful when producing a cluster of workstations which are separated by partitions. For example, a single support post can act as a common leg for a plurality of workstation work tops and as a common support member for a plurality of partition screens. Since a single support post can support a plurality of partitions and/or work tops the number of components required is reduced.

In another example, at least two work tops from the set of workstations can share a support post. Each work top can be supported by a different support element attached to the common support post. Alternatively, a single support element attached to a support post, can be arranged to support two adjacent work tops.

Figure 1B:
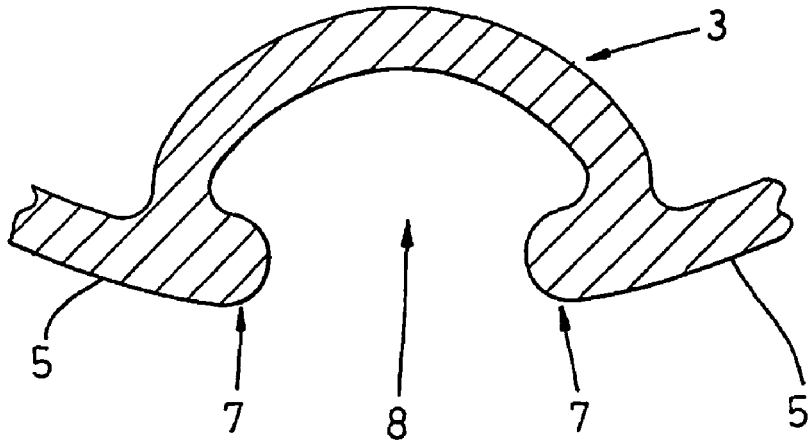

An embodiment of the present invention will now be described, by way of example only, with reference to the accompanying drawings in which like references indicate equivalent features, wherein:

FIG. 1*a* is a cross-section of a support post having eight longitudinal channels;

FIG. 1*b* is a detailed cross-section of a channel of the support post of FIG. 1*a;*

Figure 1C:
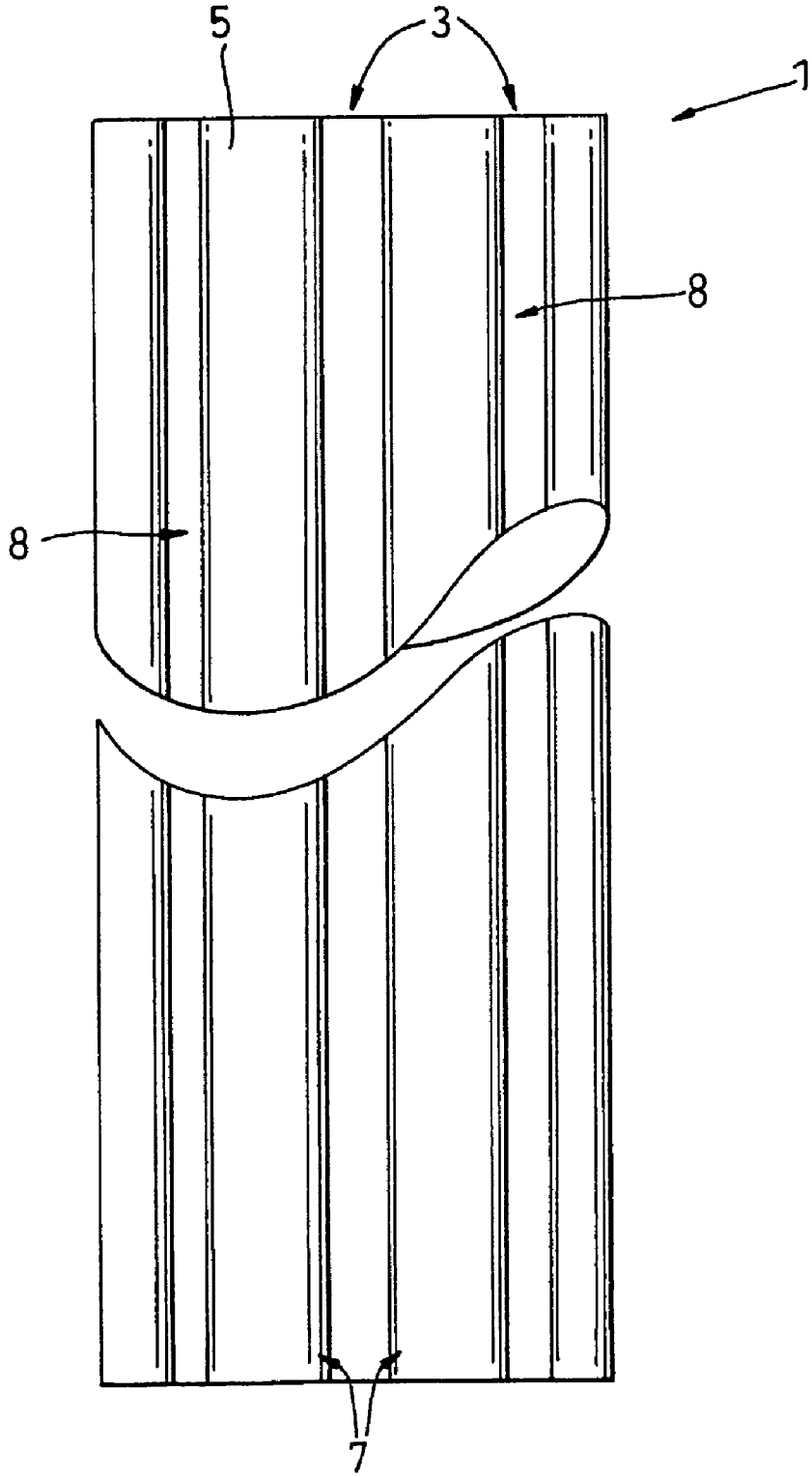

FIG. 1*c* is a side elevation of the support post of FIG. 1*a;*

Figure 2A:
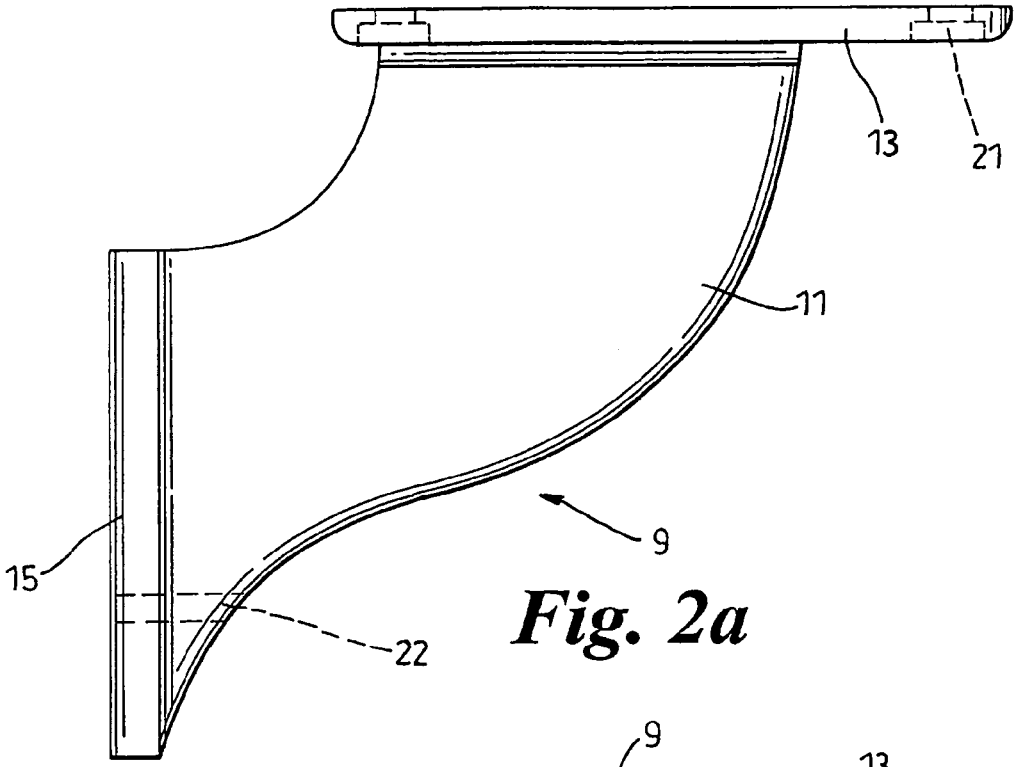
Figure 2C:
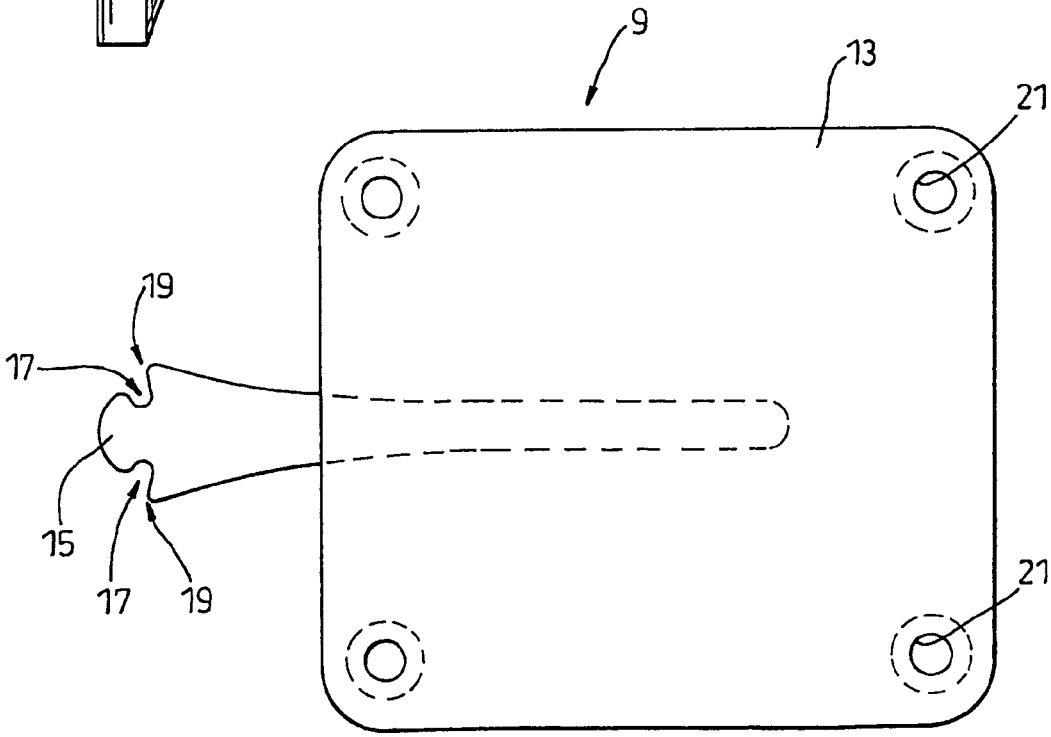
Figure 2B:
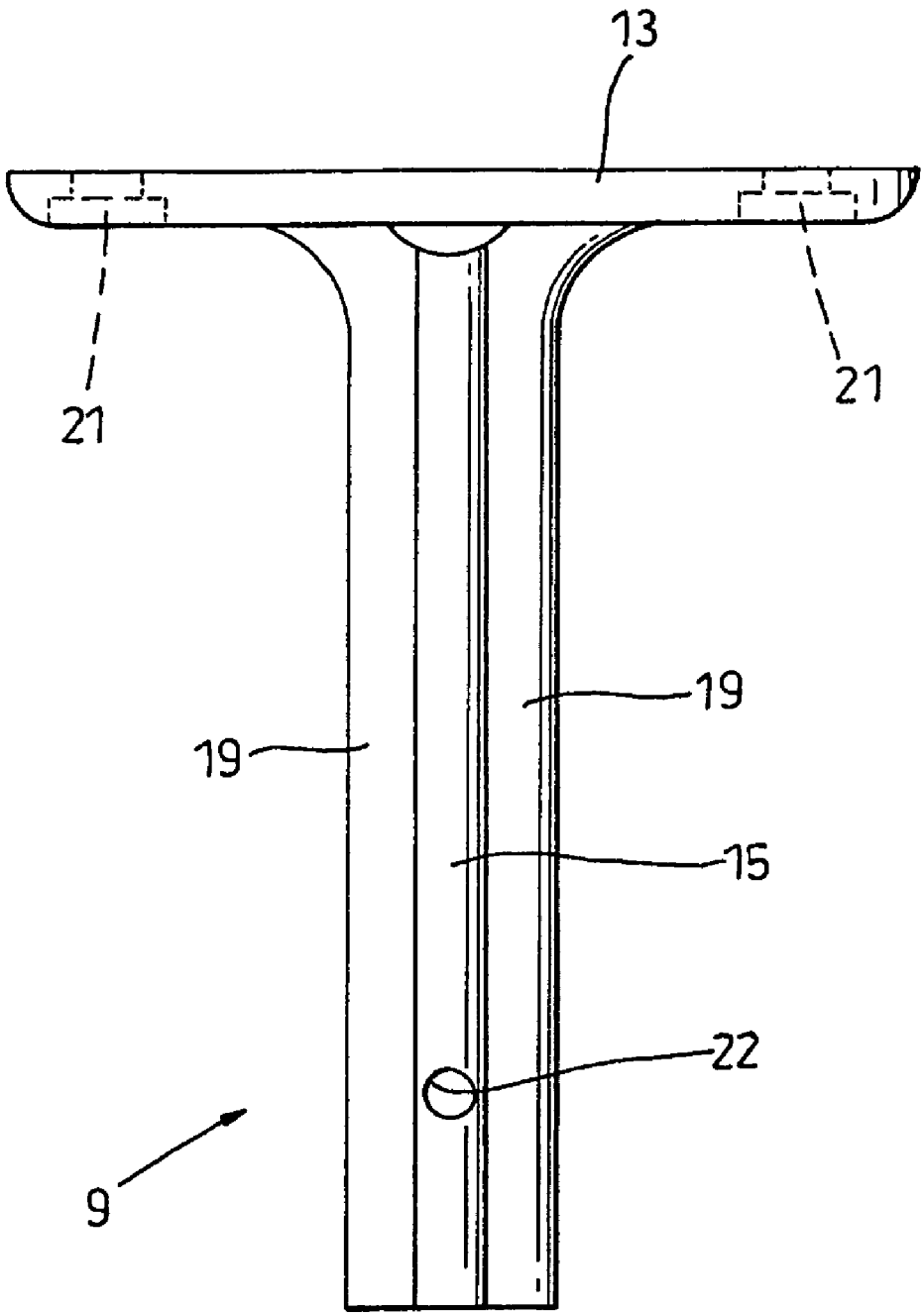
Figure 3A:
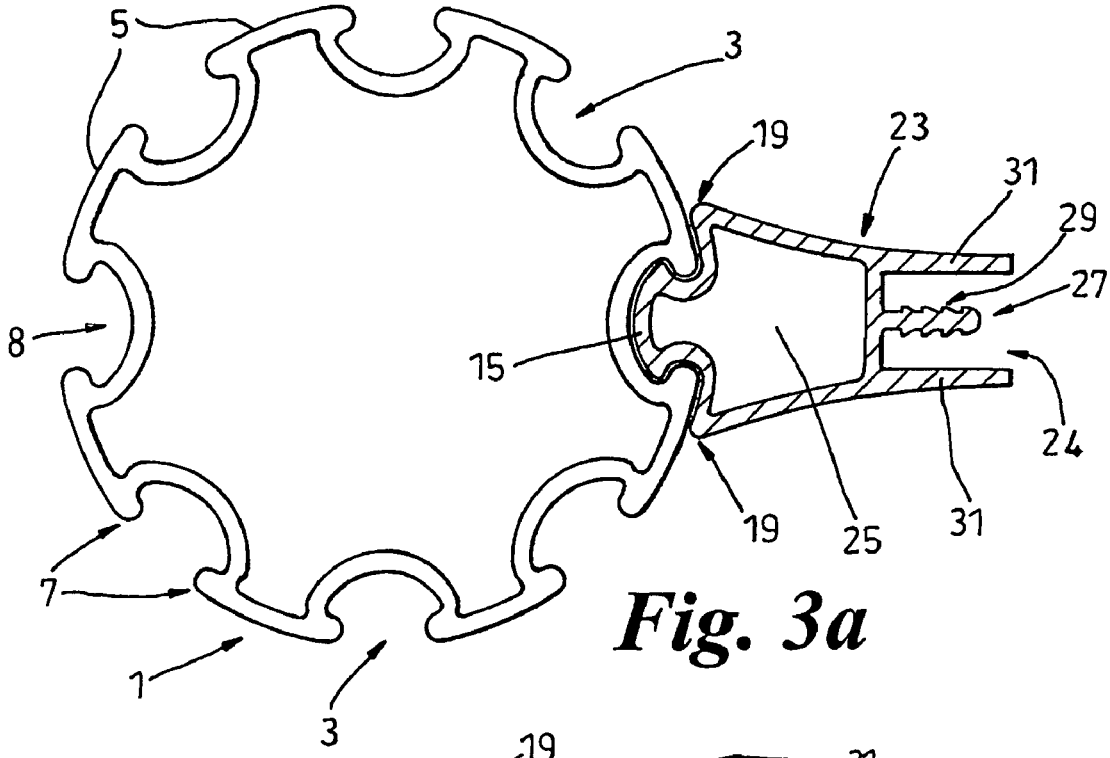
Figure 3B:
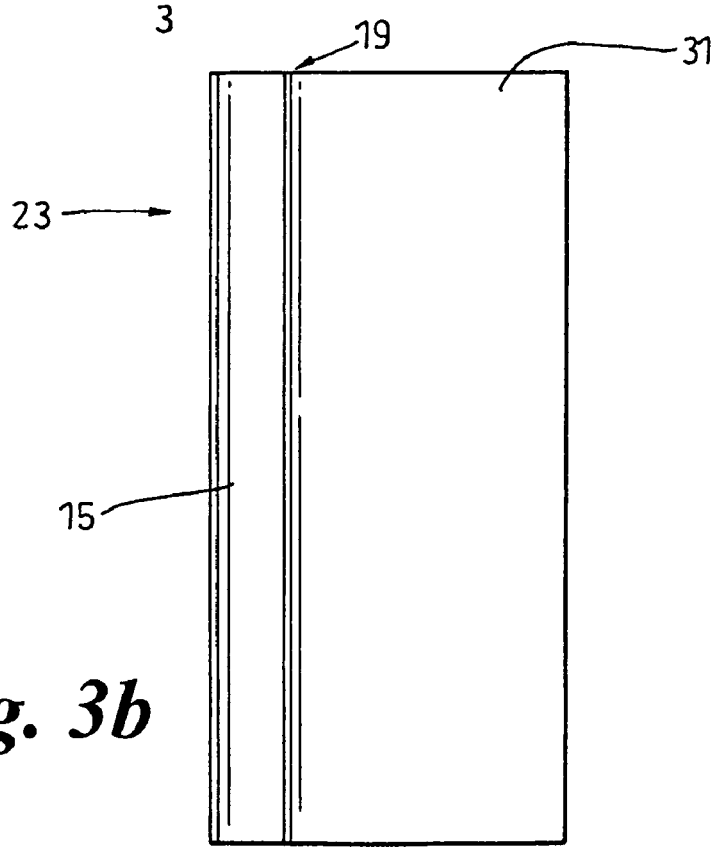

FIG. 2*a* is a side elevation of a support element for a work top;

FIG. 2*b* is an end elevation of a support element for a work top;

FIG. 2*c* is a plan view of a support element for a work top;

FIG. 3*a* is a sectional view of a support post and a support element for a partition panel;

FIG. 3*b* is a side elevation of the support element shown in FIG. 3*a*

Figure 4A:
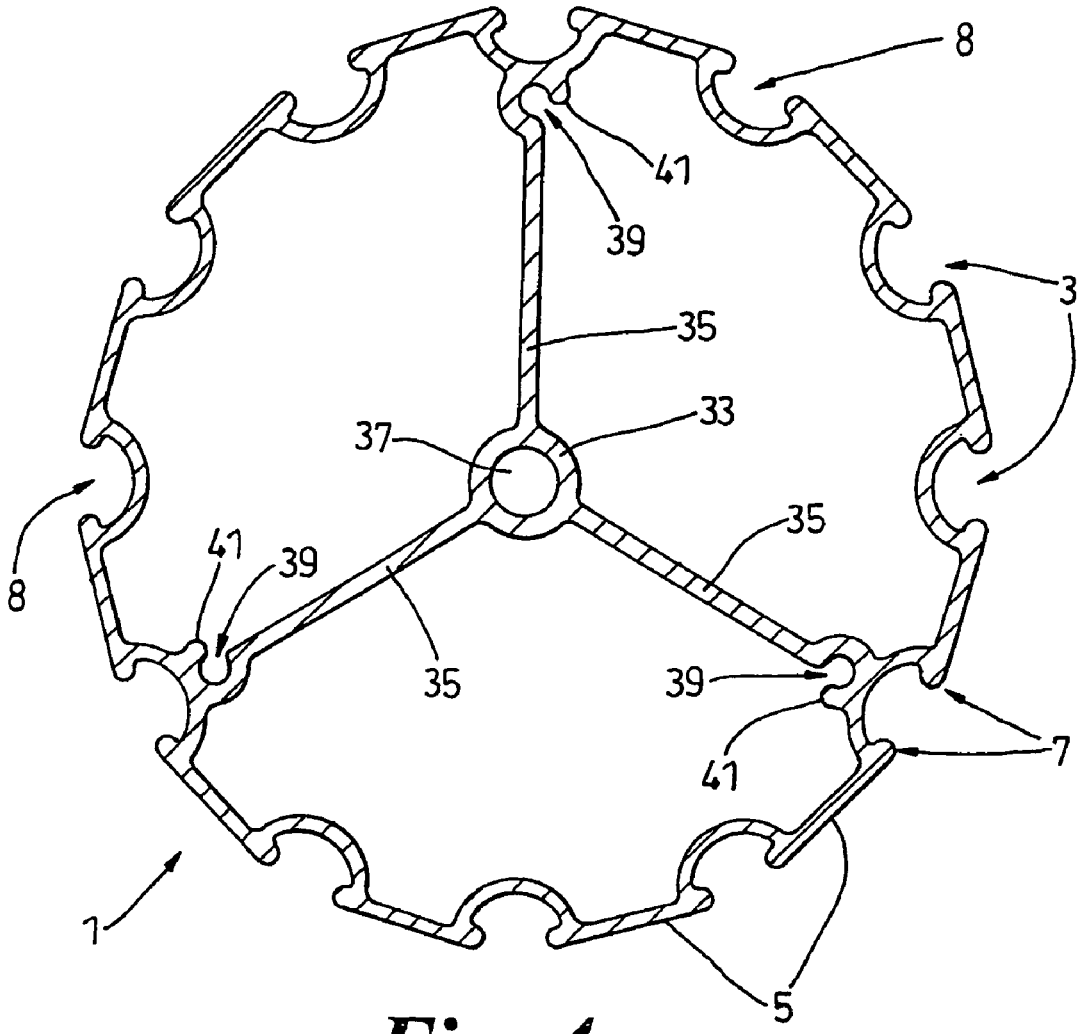
Figure 4B:
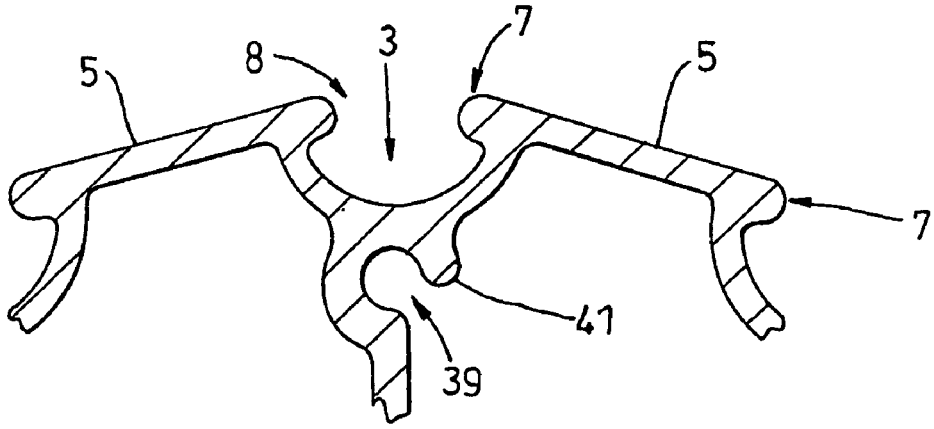

FIG. 4*a* is a cross-section of a support post having twelve channels;

FIG. 4*b* is a detailed cross-section of a channel of the support post of FIG. 4*a;*

Figure 5:
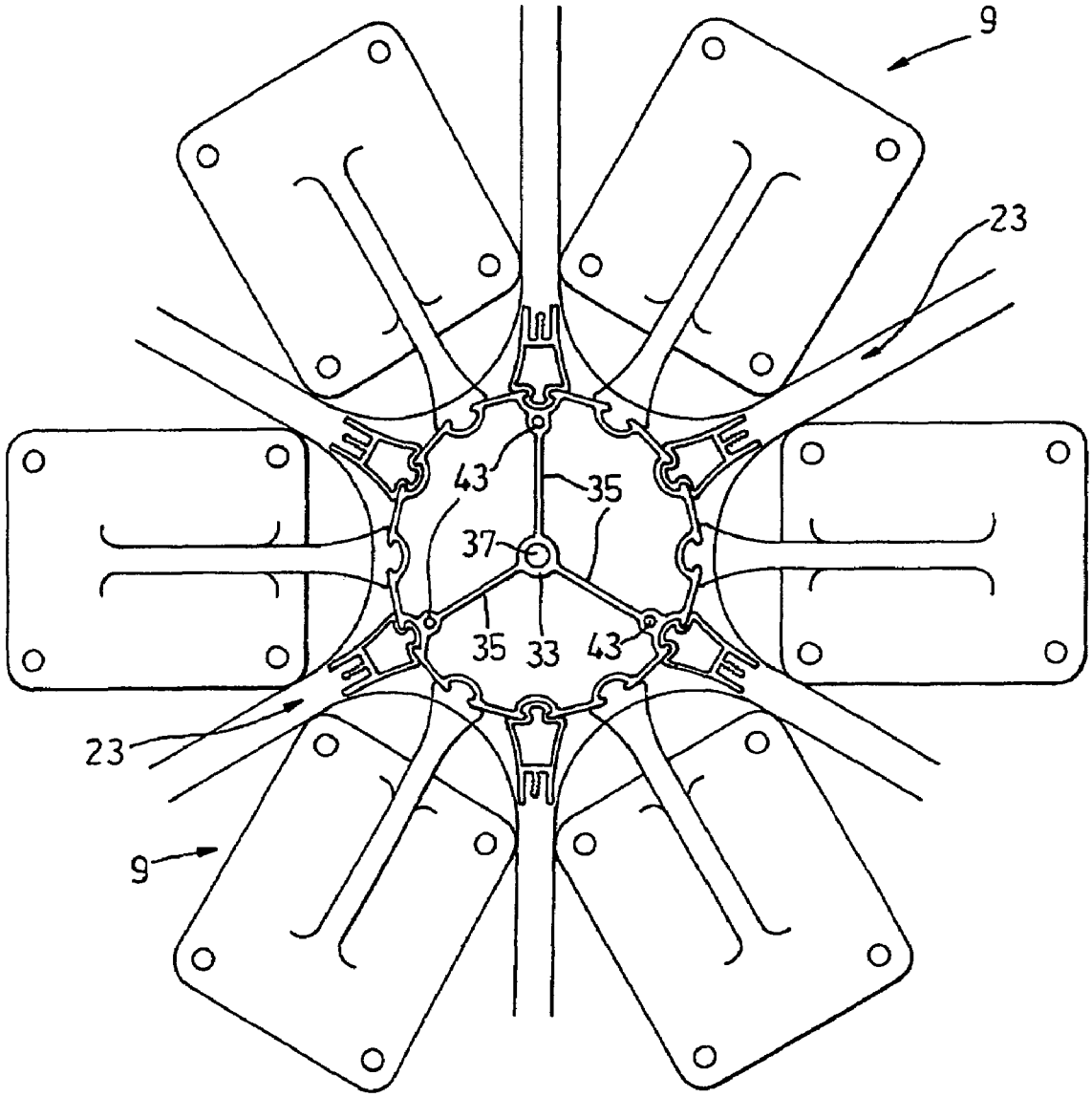
Figure 6A:
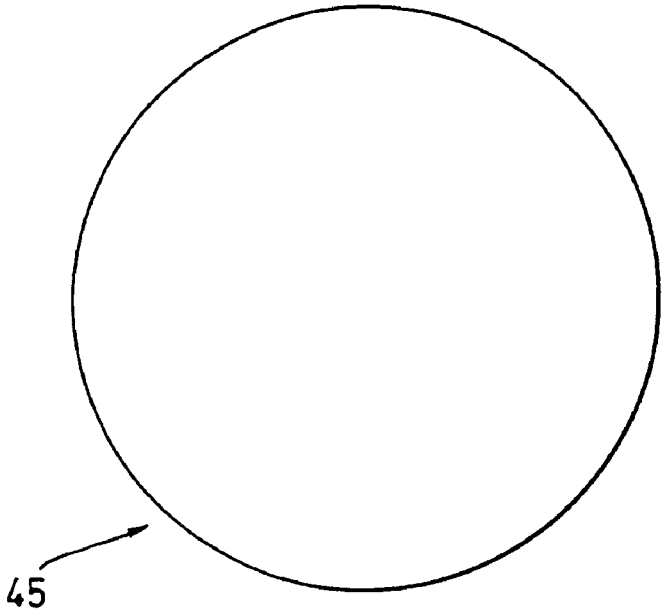
Figure 6B:
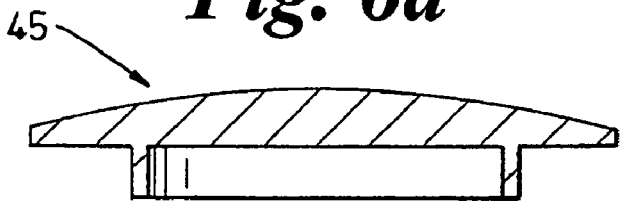
Figure 6C:
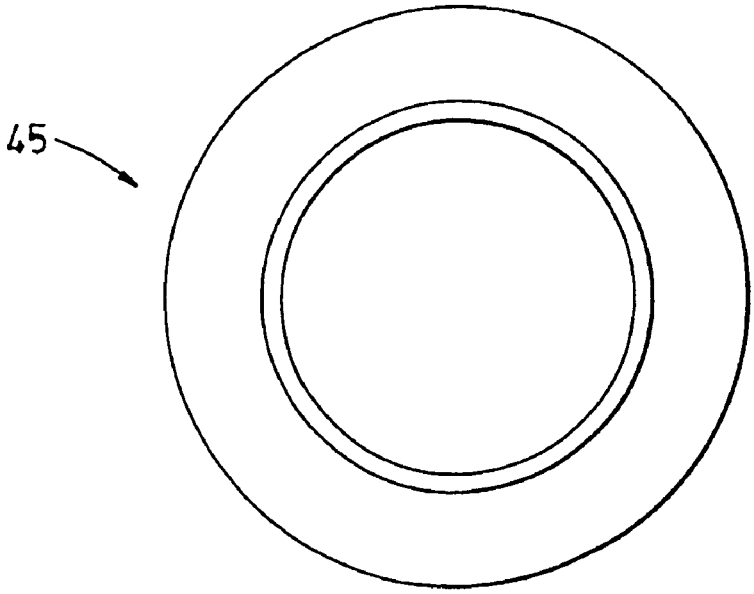
Figure 7:
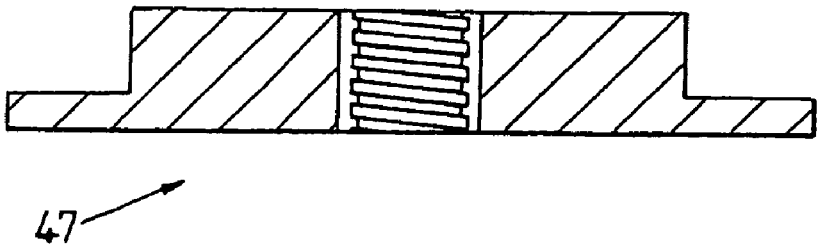
Figure 8A:
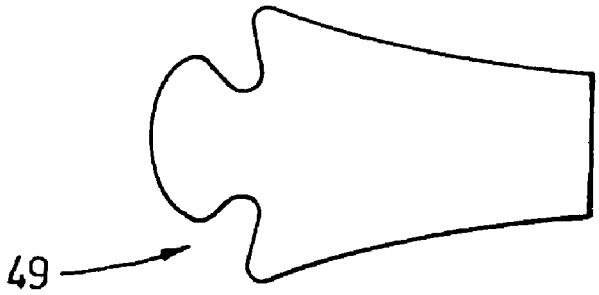
Figure 8B:
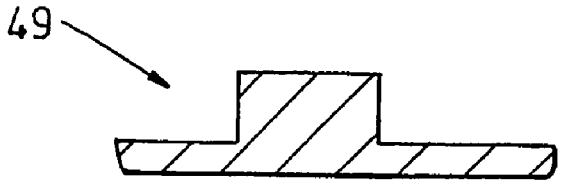
Figure 8C:
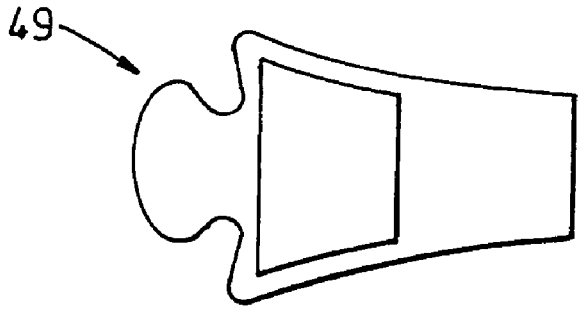
Figure 9A:
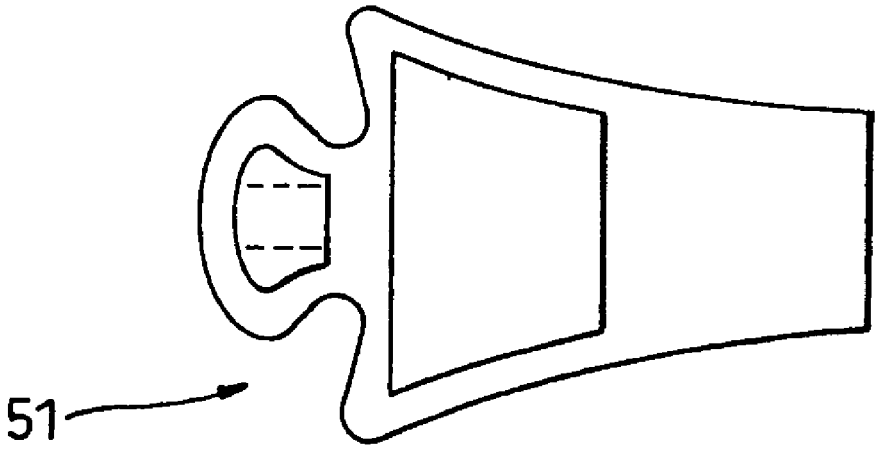
Figure 9B:
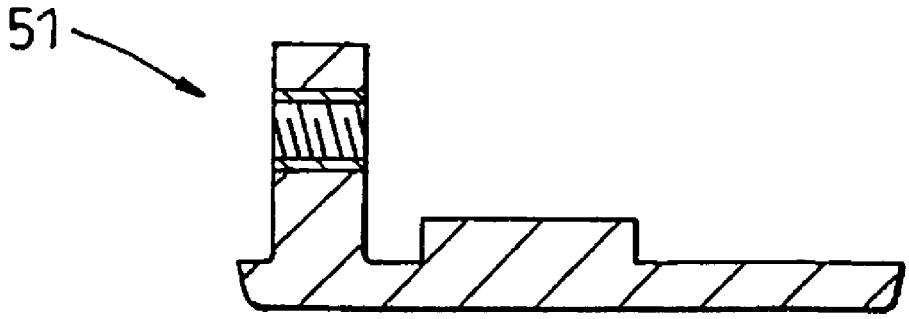

FIG. 5 is a plan view of a support post having twelve channels, showing location positions for six support elements for partition screens and six support elements for work tops;

FIGS. 6*a-c* are top plan, side section and bottom plan views of an end-cap for a support post;

FIG. 7 is a side-section of a foot for a support post;

FIGS. 8*a-c* are top plan, sectional and bottom plan views of an end-cap for a partition support element; and FIGS. 9*a-b* are bottom plan and sectional views of a foot for a partition support element.

Figure 10:
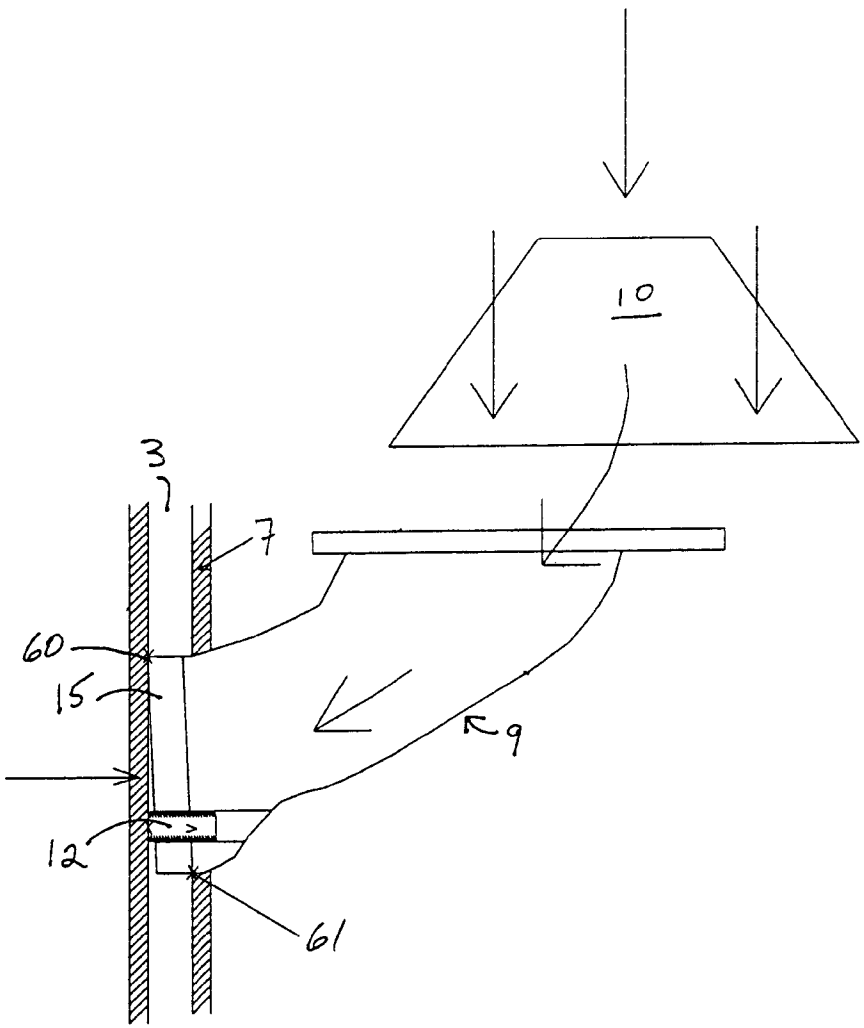

FIG. 10 is a side sectional view of the support element.

FIGS. 1*a-c* show a substantially cylindrical support post 1 having eight longitudinal grooves 3, or channels, that run the entire length of the support post 1. The grooves 3 are arranged in parallel and are equally spaced about the circumference of the support post 1 at an angle of 45 degrees. The support post 1 has an outside diameter of 70 mm, and a wall thickness of approximately 2 mm although this can vary, particularly around parts of the groove 3. Between adjacent grooves 3 are parts of the support post 1 that define the outer wall 5 of the support post 1.

Each groove 3 has a uniform arcuate cross-section and is open at each end of the support post 1. A pair of lips 7 run along the longitudinal edges of the groove 3 for the full length of the groove 3, forming a mouth 8. The opposed lips 7 of each groove 3 are parallel to each other and are parallel with the longitudinal direction of the groove 3. The body of the groove 3 has a maximum width of approximately 13 mm and the distance between the lips 7 is approximately 9 mm. The maximum depth of the groove 3 is 8 mm. Each groove 3 is arranged to receive a support element 9,23.

The support post 1 is preferably extruded from aluminium, an aluminium alloy, or from a plastics material but is not limited to this form of manufacture or material. The support post 1 length is typically in the range 385-2340 mm, for example, a support post 1 having a length of 685 mm can provide a desk height of around 720 mm.

FIGS. 2*a-c* show a support element 9 used to support a workstation work top. The support element 9 includes a body 11, a rectangular support plate 13 and a support post connector element 15 which has a complementary profile to the profile of the grooves 3. The width and height of the connector element 15 are 12 mm and 87 mm respectively. The support element 9 has two undercut portions 17 which are complementary to the lips 7 of the groove 3. The lips 7 form retaining walls which prevent the support element 9 from falling out of the groove 3. The support element has two shoulders 19 that are arranged to abut the outer wall 5 of the support post 1. The width of the support element 9 from shoulder to shoulder is 24 mm. The support element 9 for a work top is a type of bracket.

The grooves 3 are smooth to allow support elements 9,23 to slide along them. This allows the support elements 9,23 to be easily positioned within the grooves 3 and facilitates easy construction of workstation/partition arrangements. The grooves 3 have substantially identical cross-sectional profiles to enable the interchangeability of support elements 9,23, and likewise, the support elements 9,23 have substantially identical profiled complementary connector elements 15.

The support plate 13 is arranged for attachment to the underside of a workstation work top by bolts and includes a number of countersunk bolt holes 21. Alternatively, the plate 13 can be screwed or adhered to the work top.

A hole 22 is formed through the body 11 and the connector element 15 of the support element 9. Preferably the hole 22 is formed towards the lower end of the connector element 15. This hole 22 has a screw thread and is arranged to receive a grub screw. The overall height of the support element 9, including the plate 13, is 127 mm.

The support element 9 is located in a groove 3 by sliding the connector element 15 into the groove 3 at one end of the support post 1. Preferably the fit is tight, but allows the support element 9 to slide along the groove 3. The two undercut portions 17 are complementary to the groove lips 7 and the shoulders 19 are complementary to the outer wall parts 5. Referring to FIG. 10, the groove lips 7 retain the support element 9 within the groove 3 when the support post 1 is vertically mounted. The position of the support element 9 relative to the groove 3 is continuously adjustable since the connector element 15 can slide within the groove 3 to the desired position. The position of the support element 9 can then be fixed. Preferably this is achieved by tightening the grub screw 12 in the support element 9 against the support post 1. The grub screw 12 applies pressure to, for example, an inner wall of the groove 3. The grub screw 12 applies a moment to the connector element 15 such that its upper end 60 applies pressure to the inner wall and its lower end 61 to the groove lips 7, thereby creating a pressure triangle fixing the support element 9 in place. This arrangement is particularly advantageous since when loading is applied to the support element 9, for example by a person working at a desk, the load biases the grub screw 12 against the inner wall thereby increasing friction between the support element 9 and the support post 1 thus increasing the resistance to slippage. We have found that this locking arrangement is sufficiently strong to meet all current statutory requirements.

Variations of this approach can be used for example by forming holes in the support post 1 to locate the support elements 9 in set positions. The invention is not to be considered as being limited to furniture support systems including screw elements for applying pressure to the groove 3. For example, a cam or toggle device could be used to apply pressure to the support post 1.

FIGS. 3*a-c* show views of a support element 23 for a partition screen. The partition support element 23 has a support post connector element 15 and two shoulders 19 as described above, and for the same purpose has the equivalent components of the work top support element 9. The partition support element 23 also includes a cavity 25, which reduces the weight of the support element 23, and a partition connector element 24. The partition connector element 24 includes a male connector member 27, having locking teeth 29, which is positioned between two walls 31. The partition screen is interposed between the walls 31 and the male connector member 27 engages with a female connector socket in the partition screen. The locking teeth 29 in engagement with the female connector socket provide sufficient friction to prevent the partition screen from disengaging from the partition support element 23.

The male connector member 27 can run the full height of the partition support element 23 as shown in the extruded partition support element 23 of FIGS. 3*a-b* or, alternatively, may consist of a number of discrete connector members 27 spaced along the height of the partition support element 23.

FIGS. 4*a* and 4*b* show a substantially cylindrical support post 1 having a diameter of 130 mm and having twelve longitudinal grooves 3 which run the full length of the support post 1.

The grooves 3 have a uniform arcuate cross-section and are open at each end of the support post 1. Similarly to the support post 1 of FIGS. 1*a-c*, each groove 3 has a lip 7 running along each longitudinal edge of the groove 3 to the full length of the groove 3. The opposing lips 7 of each groove 3 are parallel to each other and are parallel with the groove 3. The dimensions of the grooves 3 are substantially the same as the dimensions of the grooves 3 of the eight fluted support post 1 shown in FIGS. 1*a-c*.

The outer wall portions 5 of the cylindrical support post 1 of FIGS. 4*a* and 4*b* have slight concave profiles to accommodate the shoulders 19 on the support elements 9,23.

The support post 1 of FIGS. 4*a* and 4*b* has a reinforcing structure to strengthen the member. The structure includes a central hub 33, concentric with the outer wall 5 and grooves 3, and spurs 35 that radiate from the central hub 33 to three of the grooves 3. The spurs 35 are angularly spaced at intervals of 120 degrees. The central hub 33 and the spurs 35 run the fall length of the support post 1. The hub 33 also has an axial cavity 37 having a diameter of 9 mm running the full length of the hub 33.

At the spur 35-groove 3 interface, the spur 35 is hooked, having an internal diameter of 4 mm and an opening 39 between the hook tip 41 and the spur 35 of 60 degrees.

FIG. 5 shows a support post 1 having a similar configuration to the support post 1 of FIG. 4, the main difference being that the spurs 35 radiating from the central hub 33 do not have hook shapes at the groove 3-spur 35 interface. Instead, the thickness of each spur 35 at the groove 3-spur 35 interface in the support post 1 of FIG. 5 is increased to accommodate a cylindrical cavity 43 having a 4 mm diameter.

Although the support posts 1 of FIGS. 1, 4 and 5 can be manufactured in a variety of sizes, the support posts 1 of FIGS. 4 and 5 have the additional advantage that two or more support posts 1 can be joined end to end. This is achieved by inserting one end of a rod (not shown) into the cavity of the central hub 33 at one end of a support post 1 and inserting the other end of the rod into the central hub 33 at one end of a second support post 1. Optionally, additional rods (not shown) can be inserted into the hooks at the spur 35-groove 3 interfaces of the support post 1 of FIG. 4 or the cavities 43 at the spur 35-groove 3 interfaces of the support post 1 of FIG. 5. These additional rods prevent relative angular movement between the connected support posts 1.

For the support post 1 of FIG. 4, the additional rods can be snap-fitted into the hooks by twisting the support posts 1 to be connected in opposite directions.

The operation of the furniture support system will now be described with reference to FIGS. 1 to 5.

Typically, support posts 1 having a length in the range of 385-2340 mm are used. The number of support posts 1, work top support elements 9 and partition support elements 23 depends on the desired workstation cluster design. The connector element 15 of each of the support elements 9,23 is fitted into its respective groove 3 in each of the support posts 1 from one of the ends of the support post 1.

For the work top support elements 9, the length of the connector element 15 is around 87 mm which is much shorter than the length of the support post 1, and hence the length of the groove 3. Therefore the position of the work top support element 9 can be adjusted in its groove 3 such that the top of the plate 13 is set at the appropriate height relative to the floor to support the work top at the desired working height. When the support post 1 is vertically mounted the support plate 13 is substantially horizontal. When the support element 9 has been positioned correctly it is locked in place using the grub screw (see FIGS. 1*a-c*).

The workstation work top is fastened to the plate 13 by bolts or screws as appropriate, each work top being supported generally by at least three support posts 1.

The partition support elements 23 are located in the support post grooves 3 in the same manner as the work top support elements 9, and similarly the position of the partition support element 23 relative to the support post 1 is adjustable. However, the length of the partition support elements 23 is typically approximately the same length as a support post 1. Therefore the connector element 15 of a partition support element 23 occupies a substantial part of the length of a groove 3 and does not require additional fixing means since, in this arrangement, it is supported by the floor when the support post 1 is vertically mounted on the floor.

Partition screens are inserted into the desired partition connector elements 24, wherein the male connector member 27 on the partition support element 23 engages with the female connector socket in the partition screen, and the locking teeth 29 hold the screen in place.

The assembly of support posts 1, support elements 9,23, work tops and partitions is so arranged to form the desired cluster of partitioned workstations.

FIG. 5 shows some of the positions at which the work top and partition support elements 23 can be located in the grooves 3. The support post 1 of FIG. 5 has alternating partition support elements 23 and work top support elements 9. The arrangement is not intended to be a practical set-up for a particular workstation cluster design but rather is illustrative that support elements 9,23 can be located in adjacent grooves 3.

The work top support element 9 takes part of the load from a workstation work top and transmits it to the support post 1 and therefore the support system operates as a work top leg. Since a number of work top support elements 9 can be attached to one support post 1, a single support post 1 can act as a leg for a number of workstations.

Furthermore, the same support post 1 can incorporate a number of partition support elements 23 which can support partition screens between workstations. A number of support posts 1 can be arranged to fully support a cluster of workstation work tops and partition screens leading to a more integrated and efficient furniture support system.

A set of support posts 1 having at least one work top support element 9 can be arranged to fully support a single workstation work top or a plurality of workstation work tops.

Additionally, a number of other components can optionally be included in the furniture support system, including end-caps 45 for support posts 1 (see FIGS. 6*a-c*). The end-caps 45 are essentially a dust cover to prevent foreign objects from entering the support post 1 cavity. The end-caps 45 also provide an improved aesthetic which is desirable in an office environment. A foot 47 may be also be added to the support post 1 to spread the loading over a larger surface area (see FIG. 7). End-caps 49 and feet 51 can also be added to the partition support elements 23 for the same reasons as applying to the support posts 1 (see FIGS. 8*a* to 9*b*). The end-caps 45,49 and feet 47,51 are preferably made from a plastics material or from aluminium or an aluminium alloy.

It will be appreciated that alterations can be made to the embodiment described above without departing from the spirit of the present invention. For example, the support post 1 can include any number of grooves 3, the cross-section of the grooves 3 and connector elements 15 can be altered, or the grooves 3 may only run for part of the length of the support post 1.

Other support elements can be used to support other types of furniture such as drawers or filing systems.

In the examples above, the grooves 3 all have the same cross-section, such that any support element 9, 23 can fit into any of the grooves 3. Alternatively, the grooves 3 in a support post 1 can have different profiles such that only certain types of support elements 9,23 can fit into particular profiled grooves 3. Also, more than one support element 9,23 can be located in a particular groove 3 to support a number of furniture objects, for example, upper and lower work surfaces.

Other fixing methods can be employed for fixing the workstation work top support elements 9 in place in the support post 1 grooves 3, such as a ratchet system.

Furthermore, the invention is not limited to substantially cylindrical support posts 1, for example, the support posts 1 can have a rectangular or hexagonal cross-section.

What is claimed is:

1. A furniture support system comprising:

a support post having a first locating formation comprising:

a channel that extends longitudinally along at least a part of the length of the support post, the channel having a longitudinal axis, a pair of lips defining a mouth, and a channel body located behind the mouth, the mouth being narrower than the channel body;

a support element having a second locating formation that is complementary to the channel and removably engaged therewith, the first and second locating formations being constructed and arranged for sliding movement in the longitudinal direction, such that the position of the support element relative to the support post is continuously adjustable; and a lock adapted to fix the position of the support element relative to the support post in a load bearing manner, wherein the second locating formation has upper and lower ends and the lock is located towards the lower end and includes a screw that is constructed and arranged for compressive engagement with the channel body on an inner face opposite the mouth thereby causing, in use, the second locating formation to adjust its orientation within the channel into a locking position in which the second locating formation is inclined to the longitudinal axis of the channel such that the lower end is pushed against an inner face of the lips and the upper end engages the inner face of the channel body opposite the mouth, so as to fix the position of the support element by increased friction between the support element and the support post.

2. A furniture support system according to claim 1, wherein the first locating formation extends along substantially the entire length of the support post.

3. A furniture support system according to claim 1, wherein the lock comprises a screw arranged to apply compressive load to the channel body.

4. A furniture support system according to claim 1, wherein the support post includes attachment means for connecting two posts end to end.

5. A furniture support system according to claim 1, wherein the support post is substantially cylindrical.

6. A furniture support system according to claim 1, wherein the support element comprises a bracket for supporting a workstation work top.

7. A furniture support system according to claim 1, including a screen support member for supporting a partition screen.

8. A furniture support system according to claim 7, wherein the screen support member includes a third locating formation that is complementary to the first locating formation and engageable therewith, the first and third locating formations being constructed and arranged for sliding movement in the longitudinal direction, such that the position of the screen support member relative to the support post is continuously adjustable.

9. A furniture support system according to claim 1, wherein the support post includes a plurality of angularly spaced first locating formations.

10. A furniture support system according to claim 9, wherein the support post includes between three and sixteen first locating formations.

11. A furniture support system according to claim 9, wherein the support post includes between eight and twelve first locating formations.

12. A furniture support system according to claim 9, wherein the first locating formations extend substantially parallel to one another.

13. A set of workstations including a plurality of work tops and a plurality of legs for supporting the work tops, wherein at least one of the legs is arranged to support a plurality of the desk tops and comprises a furniture support system according to claim 9.

14. A workstation including a work top and a plurality of legs for supporting the work top, wherein at least one of the legs comprises a furniture support system according to claim 1 and the position of the work top relative to the support post is adjustable.

15. A furniture support according to claim 1, wherein the lock is adapted to fix the position of the support element relative to the support post by causing the upper end of the second locating formation to push against the inner face of the channel body opposite the mouth.

16. A furniture support system comprising:

a support post comprising:

a channel that extends longitudinally along at least a part of the length of the support post, said channel having a longitudinal axis, a pair of lips defining a mouth and a channel body located behind the mouth, the mouth being narrower than the channel body;

a support element including a continuous body, comprising:

a first part for supporting a load that is located outside of the channel and extends outwards from the support post and a second part comprising a locating formation having a cross-section that is substantially complementary to the cross-section of the channel and removably engaged therewith, the channel and the locating formation being constructed and arranged for sliding movement in the longitudinal direction, such that the position of the support element relative to the support post is continuously adjustable; and a lock adapted to fix the position of the support element relative to the support post in a load bearing manner, wherein the locating formation has upper and lower ends and the lock is located towards the lower end and includes a screw that is constructed and arranged for compressive engagement with the channel body on an inner face opposite the mouth thereby causing, in use, the second locating formation to adjust its orientation within the channel into a locking position;

wherein the second locating formation is inclined to the longitudinal axis of the channel such that the lower end is pushed against the inner face of the lips and the upper end engages the inner face of the channel body opposite the mouth, so as to fix the position of the support element.

17. A furniture support system according to claim 16, wherein the position of the support element is fixed by increased friction between the support element and the support post.

18. A furniture support system according to claim 16, wherein the support element includes undercut portions located between the first and second parts of the body that are each arranged to receive one of the channel lips and are each arranged substantially complementary thereto.

19. A furniture support system according to claim 1, wherein the support element includes undercut portions that are each arranged to receive one of the channel lips and are each arranged substantially complementary thereto.

* * * * *

UNITED STATES PATENT AND TRADEMARK OFFICE

CERTIFICATE OF CORRECTION

PATENT NO. : 7,578,245 B2
APPLICATION NO. : 10/509862
DATED : August 25, 2009
INVENTOR(S) : Barry Loines It is certified that error appears in the above-identified patent and that said Letters Patent is hereby corrected as shown below:

At column 2, item 57, page 1, line 2, please delete "(19" and insert --(19)--, therefor.

At column 1, line 43 (approx.), please delete "i.e" and insert --i.e.--, therefor.

At column 3, line 55, please delete "3a" and insert --3a;--, therefor.

At column 3, line 67, please delete "element; and" and insert --element;--, therefor.

At column 4, line 2, please delete "element." and insert --element; and--, therefor.

At column 5, line 14, please delete "loading is" and insert --loading 10 is--, therefor.

At column 6, line 3, please delete "fall" and insert --full--, therefor.

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,578,245 B2
APPLICATION NO. : 10/509862
DATED : August 25, 2009
INVENTOR(S) : Barry Loines It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 317 days.

Signed and Sealed this

Seventh Day of September, 2010

David J. Kappos

David J. Kappos
*Director of the United States Patent and Trademark Office*